US007770811B2

(12) United States Patent
Belding

(10) Patent No.: US 7,770,811 B2
(45) Date of Patent: Aug. 10, 2010

(54) TOY VEHICLE TRACK

(76) Inventor: Randy Belding, 1116 E. 7th St., Pella, IA (US) 50219

( * ) Notice: Subject to any disclaimer, the term of this patent is extended or adjusted under 35 U.S.C. 154(b) by 641 days.

(21) Appl. No.: 11/502,052

(22) Filed: Aug. 10, 2006

(65) Prior Publication Data

US 2008/0035748 A1 Feb. 14, 2008

(51) Int. Cl.
*E01B 23/00* (2006.01)

(52) U.S. Cl. ..... 238/10 R; 104/53; 104/55; 104/56; 104/69

(58) Field of Classification Search ..... 104/54, 104/53, 55, 56, 57, 58, 63, 69; 238/10 R, 238/10 A, 10 B, 10 C, 10 E, 10 F; 472/85; 273/120 R; 446/444, 445, 168, 169, 170
See application file for complete search history.

(56) References Cited

U.S. PATENT DOCUMENTS 2,161,314 A * 6/1939 King et al. ..... 104/60
3,734,404 A * 5/1973 Baynes et al. ..... 238/10 E
3,735,923 A * 5/1973 Brigham et al. ..... 238/10 E
4,052,067 A * 10/1977 Carmo ..... 273/109
4,504,012 A 3/1985 Fetty et al.
RE32,106 E * 4/1986 Lemelson ..... 446/138
5,074,465 A * 12/1991 Nepper ..... 238/10 E
5,078,642 A * 1/1992 Glessner ..... 446/153
5,452,893 A * 9/1995 Faulk et al. ..... 238/10 E
6,601,774 B1 8/2003 Kasimoff
6,647,893 B1 * 11/2003 Fugitt et al. ..... 104/69

* cited by examiner

*Primary Examiner*—Mark T Le
(74) *Attorney, Agent, or Firm*—Brett Trout

(57) ABSTRACT

A toy vehicle is provided which allows the track to be bent without creasing. The track is provided with a plurality of rails and side ribs which strengthen the track against deformation even when the track is provided with loops for play or coiled for transport. Stiffener bars are releasably secured to the track to form and support loops. A connector pad and suction cup are provided to allow releasable securement of the track or window or similar flat surface.

13 Claims, 7 Drawing Sheets

TOY VEHICLE TRACK

BACKGROUND OF THE INVENTION

1. Field of the Invention

The present invention relates in general to a toy track and, more particularly, to a toy track with improved resistance to creasing and breakage.

2. Description of the Prior Art

It is well known in the art to provide tracks for use in association with motorized and non-motorized toy cars. While rigid tracks may be used in association with motorized cars, for non-motorized cars a more flexible track is desirable. For typical 1/64 scale cars, a flexible track allows the track to be mounted at various heights and in various positions. The flexibility allows the track to be manipulated to change the path of cars moving along the track as desired. The flexibility also allows the track to be configured with undulations, curves and "jumps" to further add play value to the track.

To prevent cars from leaving the track, prior art tracks are typically provided with rails to maintain the toy cars on a predetermined path. One drawback associated with such prior art rails is that the stiffness of the rails causes the track to crease permanently when the track is bent. If the thickness of the track is increased to prevent creasing, when the track is bent, the rails crease instead. Such permanent creasing in the track or rails can cause the toy cars to leave the track and, over time, can cause the track or rails to rip or tear.

Another drawback associated with such prior art tracks is that since the tracks cannot be bent to a tight curvature, the tracks cannot be coiled upon themselves for transport or storage. Accordingly, prior art tracks are often provided a plurality of straight sections which may be connected to one another using plastic fasteners or the like. The use of such fasteners, however, adds the additional drawback of increased rigidity at the point of connection. Because the track cannot be bent to a tight curvature, supplemental systems must be provided specialized track sections to create loops or the like for toy cars to traverse. Because such specialized track sections are typically provided at the ends of the straight sections of track, the loops may be positioned only at predetermined points along the track. Another drawback associated with the prior art tracks is the difficulty in arranging races between multiple toy vehicles. In the prior art, for racing, two tracks must typically be mounted next to one another. Unless the two tracks are mounted in a precisely identical manner, however, the toy vehicles running along the tracks will move at different speeds, thereby providing one or the other of the toy tracks with an advantage over the other. It would be desirable to provide a multi-lane track to eliminate these drawbacks.

It would be desirable to provide a toy track which is flexible and may be bent around a tight curvature. It would also be desirable to provide such a toy track of a long unitary construction which may be coiled for storage and transport. It would further be desirable to provide means for creating loops in the track at any desired location along the track. It would further be desirable to provide multi-lane racing track. The difficulties encountered in the prior art discussed hereinabove are substantially eliminated by the present invention.

SUMMARY OF THE INVENTION

In an advantage provided by this invention, a toy vehicle track is provided which may be in excess of two meters in length and coiled for storage and transport.

Advantageously, this invention provides a toy vehicle track which may have multiple lanes for racing.

Advantageously, this invention provides a toy vehicle track which is durable and which can be manipulated into a plurality of configurations.

Advantageously, this invention provides a toy vehicle track which can be configured into multiple loops and multiple changes of direction.

Advantageously, this invention provides a toy vehicle track which can be joined with other tracks to increase layout and design configurations.

Advantageously, this invention provides a toy vehicle track which reduces small parts which could cause a chocking hazard.

Advantageously, this invention provides a toy vehicle track which provides side by side racing.

Advantageously, this invention provides a toy vehicle track which provides for compact storage.

Advantageously, this invention provides a toy vehicle track which easy to set up and take down.

Advantageously, this invention provides a toy vehicle track with simple means for mounting the track to a vertical surface.

Advantageously, this invention provides a toy vehicle track with an inexpensive, lightweight mounting system.

Advantageously, this invention provides a toy vehicle track which facilitates the formation of loops at a plurality of points along the track.

Advantageously, this invention provides a toy vehicle track of a low cost and high strength design which is also easy to maintain.

Advantageously, in the preferred example of this invention, a toy vehicle track is provided having side rails to prevent a toy vehicle from moving off the track. The toy vehicle track is also preferably provided with strengthening ribs on either side to prevent the rails or the track from creasing when the track is bent. In a preferred example of the instant invention, the track is provided with multiple lanes to allow racing. Also, in a preferred example of this invention, a releasable retainer is provided to maintain the track in a loop configuration if desired.

BRIEF DESCRIPTION OF THE DRAWINGS

The present invention will now be described, by way of example, with reference to the accompanying drawings in which:

FIG. 7 illustrates yet another alternative configuration of the toy vehicle track of the present invention;

DETAILED DESCRIPTION OF THE PREFERRED EMBODIMENT

Figure 1:
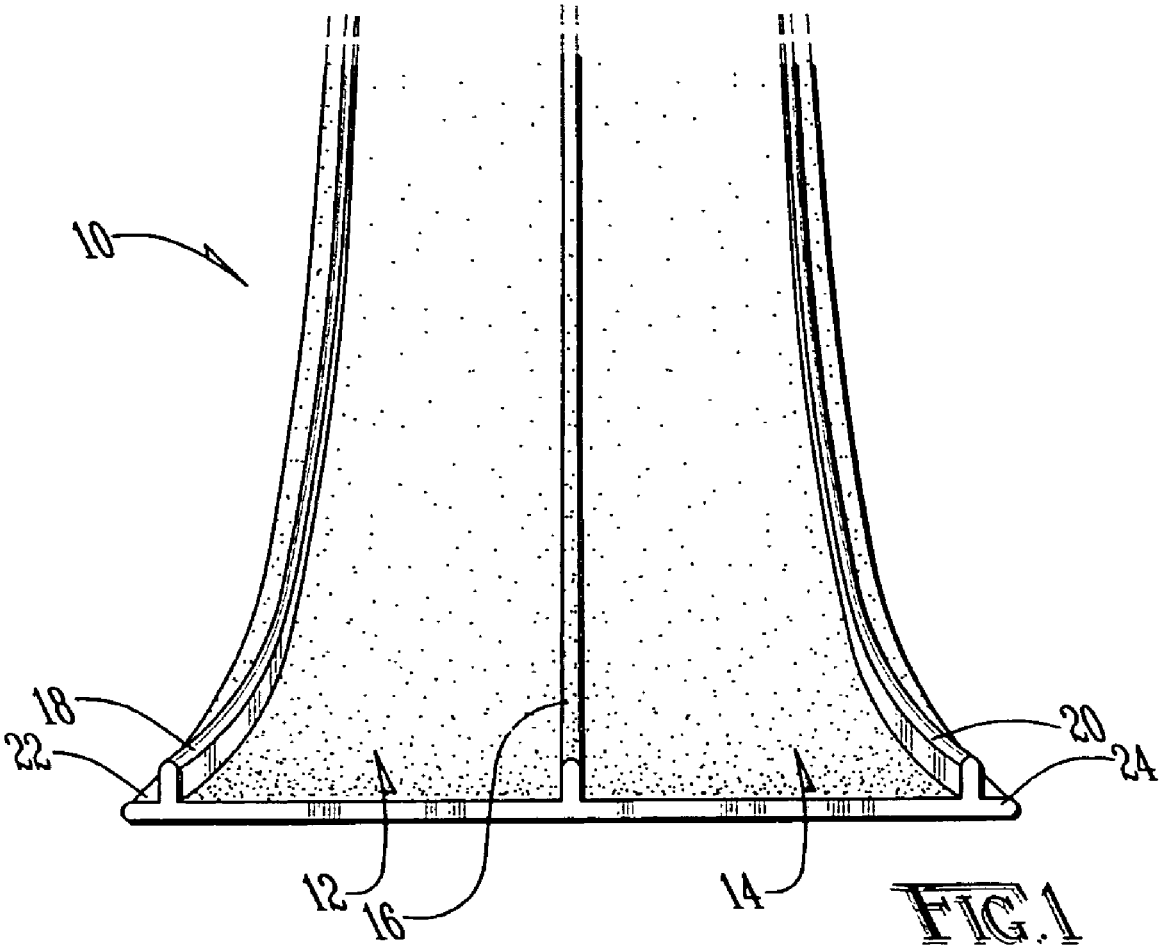
FIG. 1 illustrates a front perspective view of the end of the toy vehicle track of the present invention.
Figure 2:
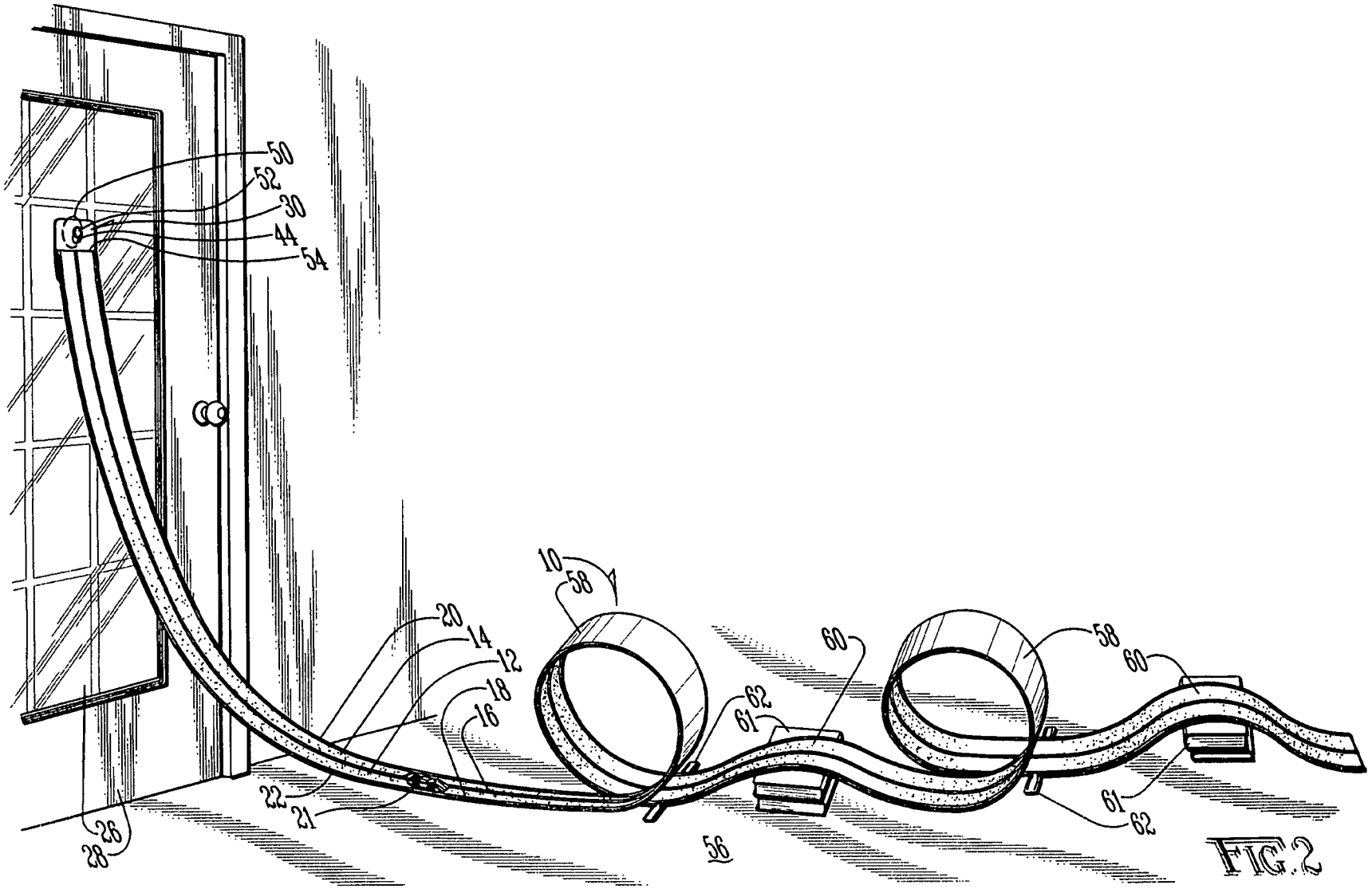
FIG. 2 illustrates a side perspective view of the toy vehicle track of the present invention, shown releasably secured to a door and configured with a plurality of loops.

A toy vehicle track is shown generally as (10) in FIG. 1. The track (10) is preferably formed of colored, extruded polyvinylchloride. As shown in FIG. 1, the track (10) includes a left track surface (12) and a right track surface (14), separated by a center rail (16). The left track surface (12) and right track surface (14) are bordered by a left rail (18) and a right rail (20), respectively. Extending laterally from, and integral with, the left track surface (12) is a left rib (22), and extending laterally from, and integral with, the right track surface (14) is a right rib (24). Although the track (10) may be constructed of any suitable dimensions or configurations, in the preferred embodiment, the left track surface (12) and right track surface (14) are each preferably between 0.5 and 20 centimeters wide, and between 0.5 and 100 millimeters thick, more preferably, between 2 and 6 centimeters wide and between 1 and 2 millimeters thick, and most preferably, about 4.3 centimeters wide and 1.5 millimeters thick, to accommodate a 1/64 scale car (21). (FIG. 2). The ribs (22) and (24) are preferably the same thickness as the track surfaces (12) and (14), and preferably extend between 1 and 10 millimeters, more preferably between 2.5 and 7.5 millimeters wide, and most preferably about 4.7 millimeters laterally from the center line of the associated rail (18) or (20).

The rails (16), (18) and (20) are preferably between 1 and 100 millimeters high, more preferably between 25 and 75 millimeters high, and most preferably about 46 millimeters high. Although the track surfaces (12) and (14), rails (16), (18) and (20), and ribs (22) and (24) may be constructed in any desired configuration relative to one another, in the preferred embodiment, the rails (16), (18) and (20) are provided perpendicular relative to the track surfaces (12) and (14). If desired, the outside rails (18) and (20) may be angled outward from the edges of the track surfaces (12) and (14). The ribs (22) and (24) are preferably parallel to the track surfaces (12) and (14), and more preferably planer and integral with the track surfaces (12) and (14).

If desired, however, the ribs (22) and (24) may be located higher on the rails (18) and (20), may undulate along the outside rails (18) and (20), or may be provided with supplemental ribs to add further strength to the toy vehicle track (10). Although the toy vehicle track (10) may be constructed with rails and ribs of any suitable configuration, the track surfaces (12) and (14), rails (16), (18) and (20), and ribs (22) and (24) are preferably constructed in a manner which prevents the track surfaces (12) and (14), and rails (16), (18) and (20), from "creasing" when the toy vehicle track (10) is coiled. Preferably the rails (16), (18) and (20) are constructed to ripple before the force of the rails (16), (18) and (20) causes the track surfaces (12) and (14) to crease. This accomplished by using a combination of thick track surfaces (12) and (14), and short flexible rails (16), (18) and (20), all constructed of a flexible material, such as polyvinylchloride, which resists creasing. If desired, rails (16), (18) and (20) may be provided to divide the track surfaces (12) and (14) into one, two, three or any plurality of track surfaces (12) and (14). The toy vehicle track is preferably between 0.5 and 5 meters long, more preferably between 1 and 3 meters long, and most preferably about 2 meters long.

Figure 3:
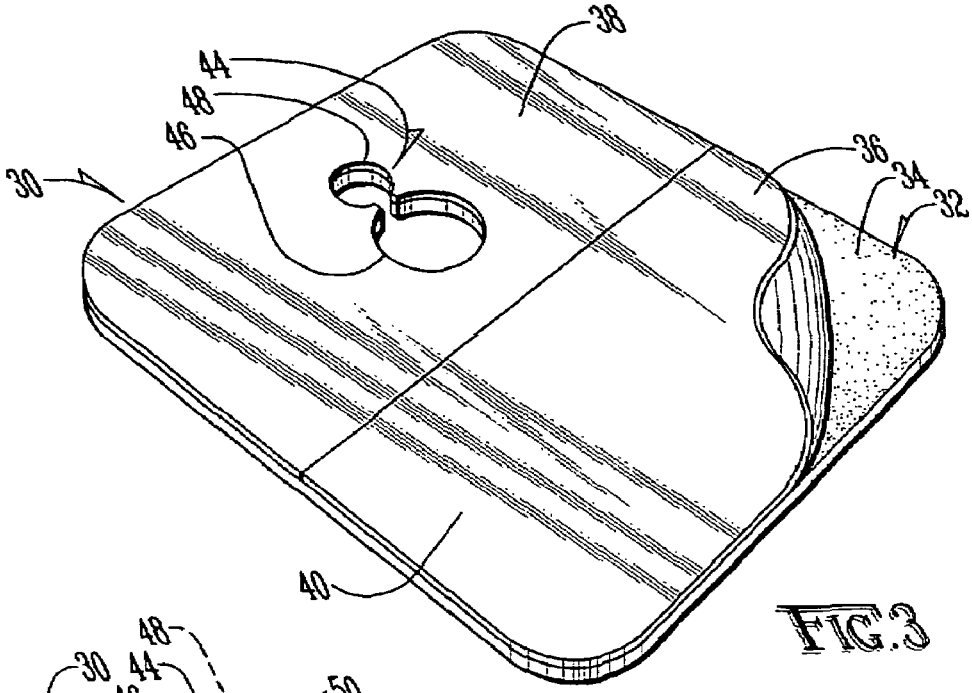
FIG. 3 illustrates a bottom plan view of the connector pad shown with as portion of the film removed.
Figure 4:
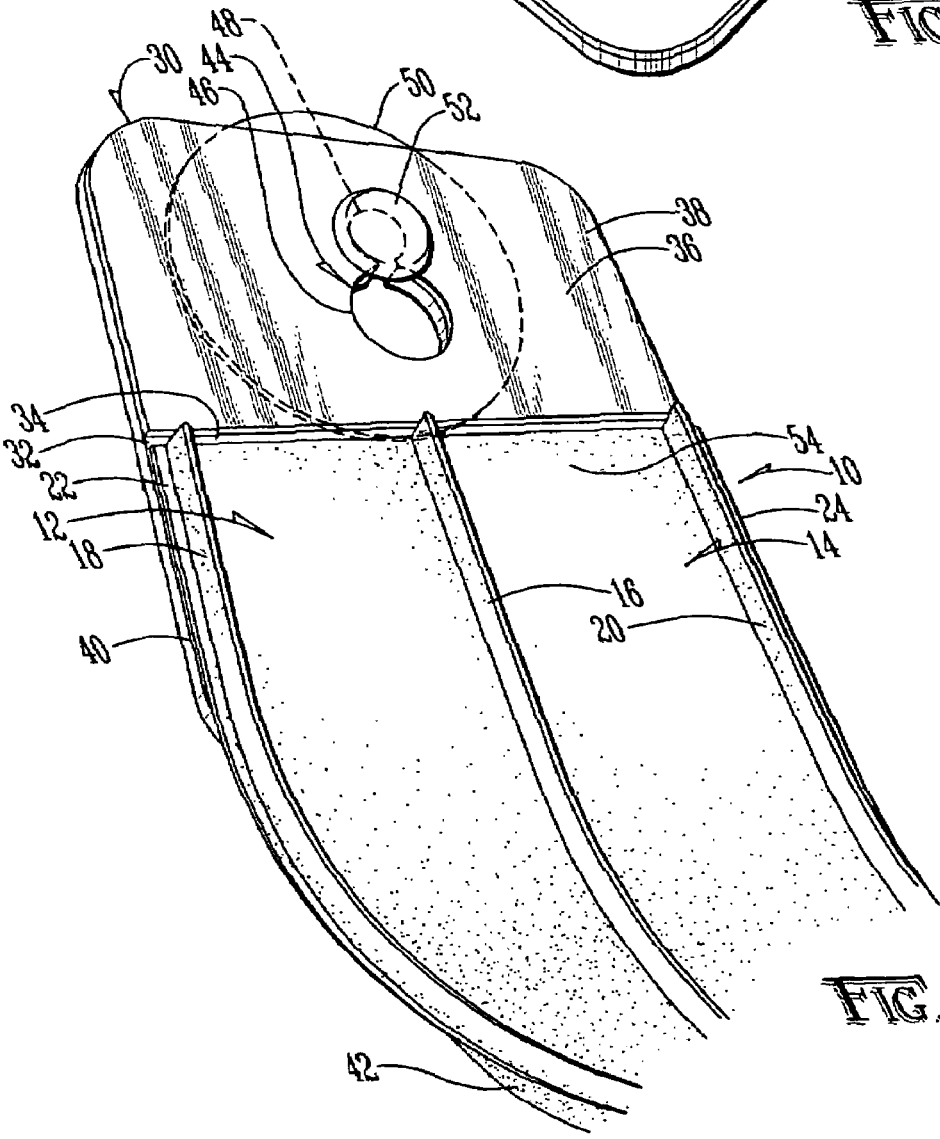
FIG. 4 illustrates a perspective view of the toy vehicle track of the present invention shown with the connector pad secured to the toy vehicle track and releasably secured to the suction cup.

As shown in FIGS. 2 and 3, when it is desired to attach the toy vehicle track (10) to the window (26) of a door (28), a thin, plastic connector pad (30) is provided. As shown in FIG. 3, the connector pad (30) is preferably provided on one surface (32) with a strong adhesive (34), such as those well known in the art. The surface (32) is preferably covered with a film (36), cut generally into a top section (38) and a bottom section (40). When it is desired to attach the connector pad (30) to the bottom (42) of the toy track (10), the bottom section (40) of the connector pad (30) is removed, revealing the adhesive (34). (FIGS. 3-4). The adhesive (34) is thereafter pressed against the bottom (42) of the toy vehicle (10) and allowed to cure. The top section (38) remains on the connector pad (30) to prevent the adhesive (34) from securing to any undesired parts. As shown in FIG. 3, the connector pad (30) is preferably provided with a die cut (44) defining a lower, larger circle (46) and an upper, smaller circle (48).

As shown in FIG. 2, when it is desired to attach the toy vehicle track (10) to the window (26) of the door (28), a standard suction cup (50) provided with a boss (52) is releasably secured to the window (26). The die cut (44) is then provided over the boss (52) and lowered until the upper circle (48) engages the boss (52). The boss (52) may be provided with a narrow center portion to retain the upper circle (48) and prevent the upper circle (48) from inadvertently becoming dislodged from the boss (52). Although the start (54) of the track (10) may be releasably secured to the window (26) at any desirable height, in the preferred embodiment, the start (54) of the track (10) is preferably releasably secured between 1 and 2 meters from the floor (56). As shown in FIG. 2, the track (10) may be configured with a plurality of loops (58) and undulations (60). The undulations (60) may be provided using simply books (61) or other materials placed under the track (10). Similarly, the loops (58) may be provided by simply looping the track (10) at the desired point.

Figure 5:
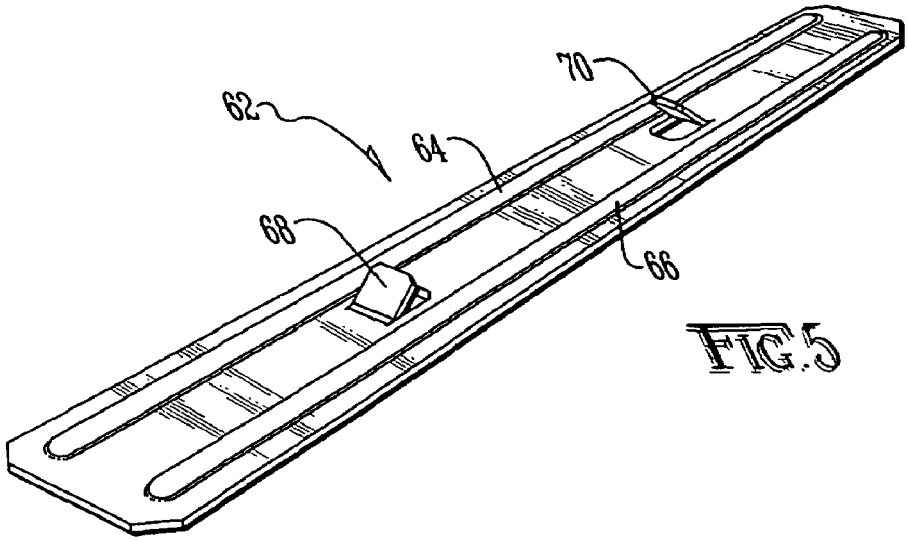
FIG. 5 illustrates a side perspective view of the stiffener bar of the present invention.

As shown in FIG. 5, a steel stiffener bar (62) is provided to secure the track (10) in place. Attaching the stiffener bar (62) to the track (10) and adjusting the location of the stiffener bar (62) allows the angle of descent of the track (10) to be adjusted, while preventing the weight of the suspended portion of the track (10) from pulling the remaining portion of the track (10) rearward, resulting in an undesirable increase in the angle of descent. Additionally, while loops (58) may be formed in the track (10) without additional support, the stiffener bar (62) may also be used to form loops (58) in the track (10) and prevent any undesired shift of the loops (58) during play. (FIGS. 2 and 5). As shown in FIG. 5, the stiffener bar (62) is preferably provided with a pair of stiffening ribs (64) and (66) running the length of the bar (62). The stiffener bar (62) is also provided with a pair of tabs (68) and (70). The tabs (68) and (70) are preferably sized and spaced to engage the ribs (22) and (24) of the track (10). The stiffener bar (62) is preferably one and one-half times the width of the track (10) and, more preferably, at least twice as long as the width of the track (10). Once the stiffener bar (62) has been placed beneath the track (10) and the tabs (68) and (70) engaged with the ribs (22) and (24), the portion of the loop (58) passing over the stiffener bar (62), but not connected to the tabs (68) and (70), rests upon the stiffening bar (62). This added downward pressure on the stiffener bar (62) further limits movement of the stiffener bar (62) and, in turn, undesired movement of the loop (58). As shown in FIG. 2, a plurality of stiffener bars (62) may be provided to provide a plurality of loops. Although the stiffener bars (62) are preferably constructed of steel, any desired material and any desired configuration may be utilized.

Figure 6:
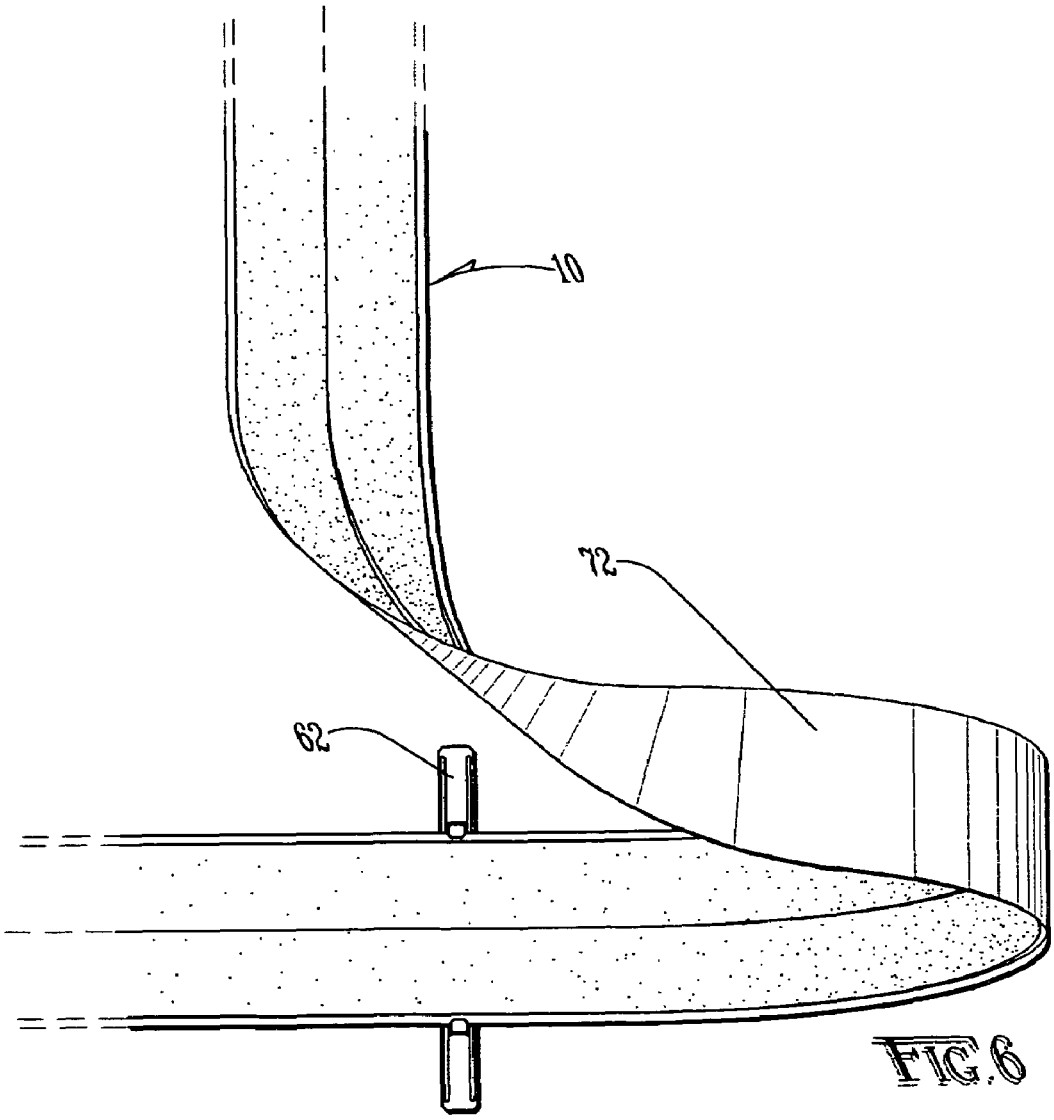
FIG. 6 illustrates an alternative configuration of the toy vehicle track of the present invention.
Figure 1:
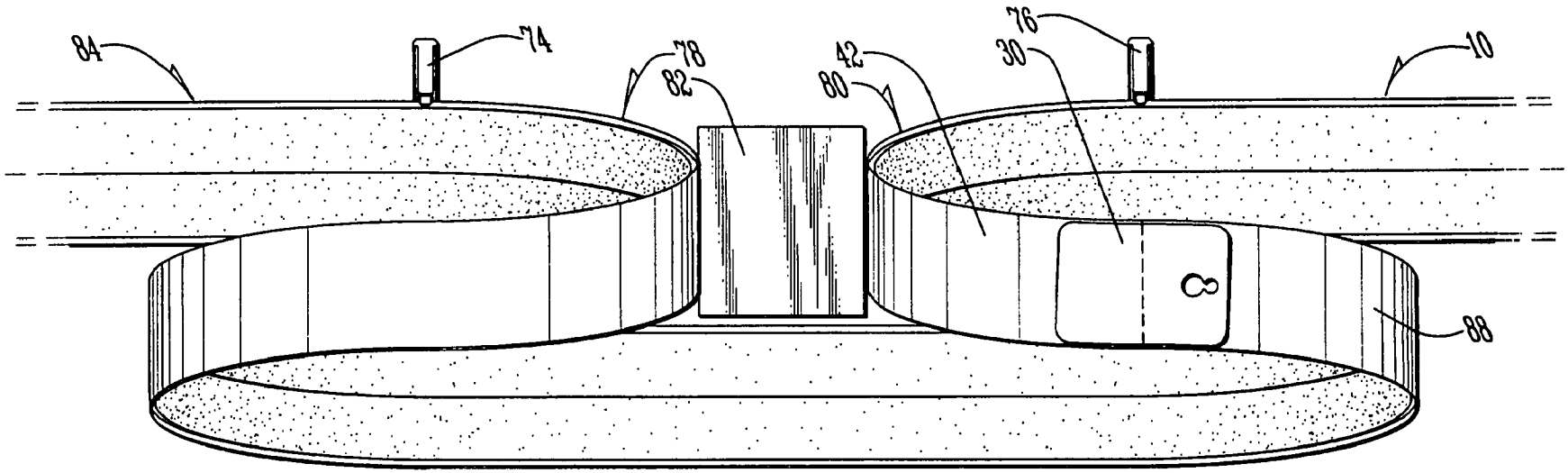

An alternative arrangement of the track (10) is shown in FIG. 6, in which a stiffener bar (62) is used to create a curving right-angled loop (72). In another alternative configuration of the track (10) is shown in FIG. 7, in which two stiffener bars (74) and (76) are used to create a pair of offset loops (78) and (80). If desired, a box (82) or similar support, may be positioned between the loops (78) and (80) to further add support to the track (10).

Figure 8:
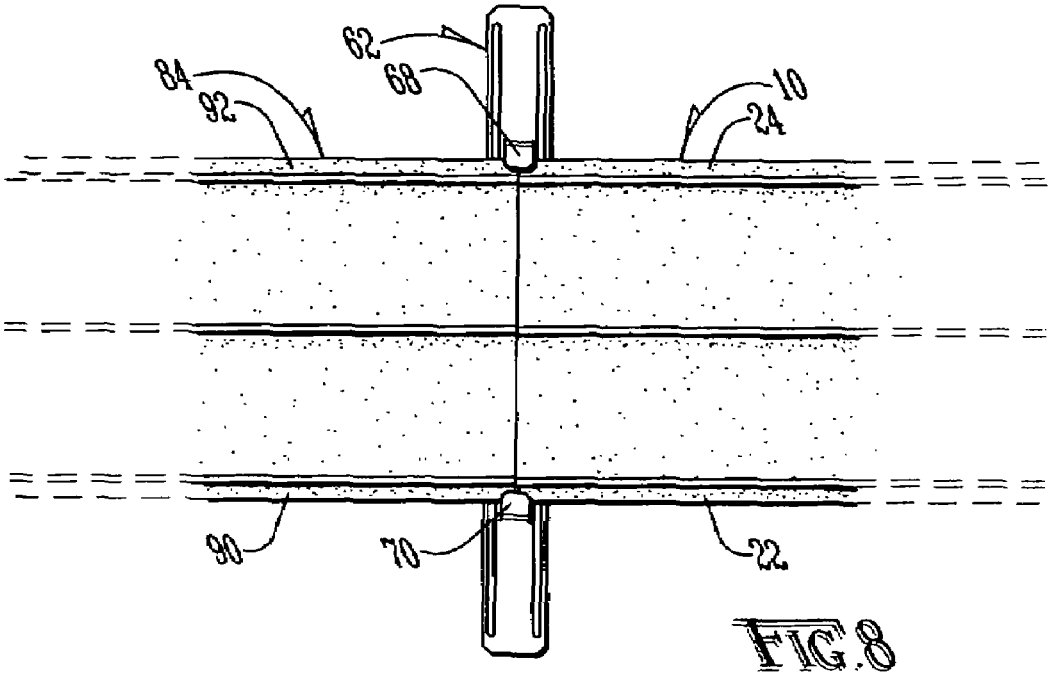
FIG. 8 illustrates an alternative method for releasably connecting two tracks of the present invention.

As shown in FIG. 7, if it is desired to couple a second track (84) to the track (10), a second connector pad (30) may be used with the entirety of the film removed. The connector pad (86) is coupled to the bottom (42) of the track (10) and the bottom (88) of the second track (84). Alternatively, as shown in FIG. 8, for a releasable connection, a stiffener bar (62) may be used to straddle the ribs (22), (24), (90) and (92) of both tracks (10) and (84) and secure the tracks (10) and (84) together. In these manners, or in any other manner known in the art, any plurality of tracks (10) may be coupled to one another.

Figure 9:
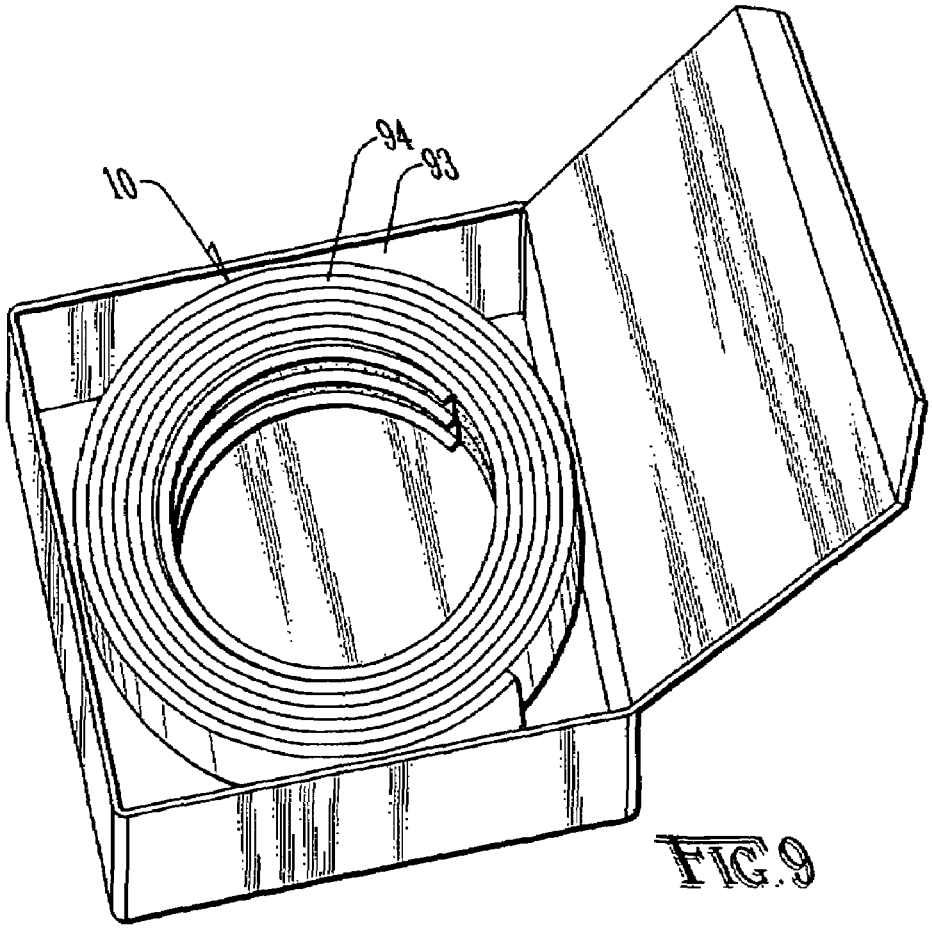
FIG. 9 illustrates a perspective view of the toy vehicle track of the present invention shown coiled for storage.
Figure 10:
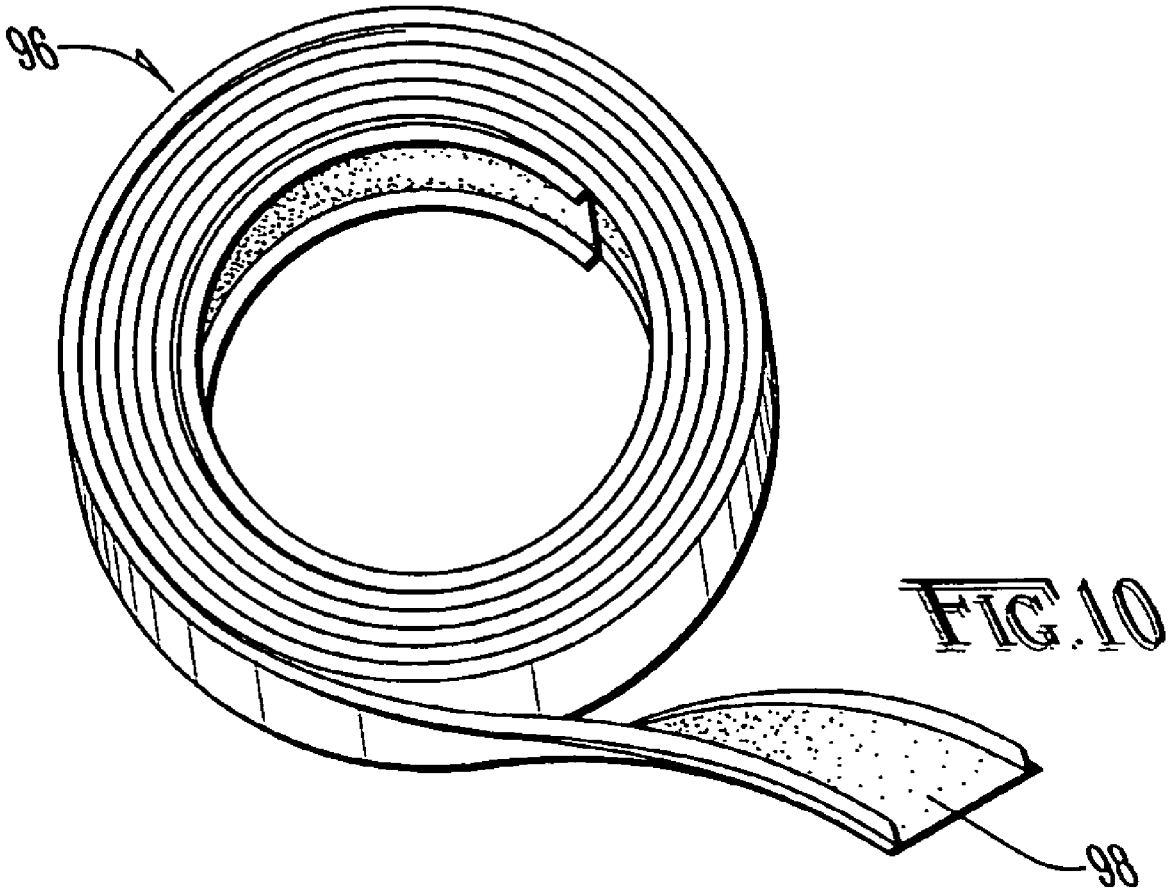
FIG. 10 illustrates an alternative single lane embodiment of the toy vehicle track of the present invention.

When it is desired to store the track (10), the track (10) may be coiled as shown in FIG. 9. Preferably, the two-meter track (10) may be coiled into a coil (94) less than 50 centimeters in diameter, and more preferably less than 20 centimeters in diameter without the track (10) permanently creasing. The track (10) may be maintained in the coiled position within a box (92), with a releasable tie (not show) or with any other suitable means known in the art. FIG. 10 illustrates an alternative embodiment of the track (96) shown with a single lane (98). The track (96) may be configured as described above and may be coupled to additional lengths of track (96) as desired.

Although the invention has been described with respect to a preferred embodiment thereof, it also to be understood that it is not to be so limited, since changes and modifications can be made therein which are within the full, intended scope of this invention as defined by the appended claims. As an example, a clamp or any other suitable means may be used to secure the track (10) to a table or the like, or the track (10) may be wedged between the top of a door and the doorframe to secure the track.

What is claimed is:

1. A toy vehicle surface comprising:

(a) A monolith flexible track at least two meters long, said track comprising:

(i) a longitudinal dimension having a first side and a second side;

(ii) a lateral dimension;

(iii) wherein said longitudinal dimension is longer than said lateral dimension; and (iv) a bottom (b) a first rail having a solid, generally, rectangular cross-section at least one millimeter high, said first rail having a first side and a second side, wherein said first rail is provided along said first side of said longitudinal dimension of said first flexible track, (c) a second rail having a solid, generally, rectangular cross-section at least one millimeter high, said second rail having a first side and a second side, wherein said second rail is provided along said second side of said longitudinal dimension of said first flexible track;

(d) a first rib at least one millimeter wide, at least a portion of which extends laterally of said first rail to a first free end;

(e) wherein said first rail and said first rib define a first outward facing right angle;

(f) wherein said first rib is on the same plane as said bottom;

(g) a second rib at least one millimeter wide, at least a portion of which extends laterally of said second rail to a second free end; and (h) wherein said second rail and said second rib define a second outwardly facing right angle, and said track includes a track surface between 2 and 6 centimeter wide and a storage coiled configuration diameter of less than 1/10th of the length of the track without the track being permanently creasing.

2. The toy vehicle surface of claim 1, wherein said first rail is located substantially perpendicularly relative to said track and to said first rib.

3. The toy vehicle surface of claim 2, wherein said first rail and said second rail are located parallel planar to one another.

4. The toy vehicle surface of claim 1, further comprising a third rail at least one millimeter tall, said third rail secured to said track between said first rail and said second rail.

5. The toy vehicle surface of claim 1, wherein said longitudinal dimension of said track is at least ten times greater than said lateral dimension.

6. The toy vehicle surface of claim 1, wherein said first rib is at least two millimeters wide and less than three centimeters wide.

7. The toy vehicle surface of claim 6, wherein said first rib is at least two meters long.

8. A track comprising:

(a) a flexible monolith metallic surface at least two meters long, said surface having a first side and a second side;

(b) a first rib having a solid, generally rectangular cross-section at least one millimeter wide, said first rib running along said first side of said flexible surface and extending to a first free end;

(c) a second rib at least one millimeter wide, said second rib running along said second side of said flexible surface and extending to a second free end;

(d) a first rail at least one millimeter high, said first rail secured between said first rib and said flexible surface;

(e) wherein said first rail and said first rib define a first outwardly facing right angle;

(f) wherein said first rail is on the same plane as said flexible surface;

(g) a second rail at least one millimeter high, said second rail secured between said second rib and said flexible surface;

(h) wherein said second rail and said second rib define a second outwardly facing right angle;

(i) wherein said second rail is on the same plane as said flexible surface;

(j) a suction cup;

(k) a retainer provided on said suction cup;

(l) a keeper secured to said flexible surface, said keeper provided with an opening; and (m) wherein at least a portion of said retainer extends through said opening, and said track includes a track surface between 2 and 6 centimeter wide and a storage coiled configuration diameter of less than 1/10th of the length of the track without the track being permanently creasing.

9. The track of claim 8, wherein the height of said first rail is greater than the width of said first rib.

10. The track of claim 8, wherein said first rail is located substantially perpendicularly relative to said flexible surface and to said first rib.

11. The track of claim 8, wherein said first rib is at least two millimeters wide and less than three centimeters wide.

12. A track comprising:

(a) a flexible monolith metallic surface at least two meters long, said surface having a first side extending to a first rib having a first free end and a second side extending to a second rib having a second free end;

(b) a first flexible rail having a solid generally rectangular cross-section at least one millimeter tall, said first flexible rail coupled to said flexible surface at least one millimeter inward from said first free end;

(c) wherein said first rail and said first rib define a first outwardly facing right angle;

(d) a second flexible rail having a solid, generally rectangular cross-section at least one millimeter tall, said second flexible rail coupled to said flexible surface at least one millimeter inward from said second free end;

(e) wherein said second rail and said second rib define a first outwardly facing right angle; and (f) a dividing rail at least one millimeter tall, said dividing rail provided between said first flexible rail and said second flexible rail in a manner which defines a first race surface in contact with said dividing rail and a second race surface in contact with said dividing rail, wherein said dividing rail is less than one-fifth the width of said first race surface, and said track includes a track surface between 2 and 6 centimeter wide and a storage coiled configuration diameter of less than 1/10th of the length of the track without the track being permanently creasing.

13. The track of claim 12, wherein an underside of said flexible surface is substantially flat and unobstructed.

* * * * *